US010297267B2

(12) United States Patent
Ebenezer et al.

(10) Patent No.: US 10,297,267 B2
(45) Date of Patent: May 21, 2019

(54) DUAL MICROPHONE VOICE PROCESSING FOR HEADSETS WITH VARIABLE MICROPHONE ARRAY ORIENTATION

(71) Applicant: Cirrus Logic International Semiconductor Ltd., Edinburgh (GB)

(72) Inventors: Samuel P. Ebenezer, Tempe, AZ (US); Rachid Kerkoud, Gilbert, AZ (US)

(73) Assignee: Cirrus Logic, Inc., Austin, TX (US)

( * ) Notice: Subject to any disclaimer, the term of this patent is extended or adjusted under 35 U.S.C. 154(b) by 138 days.

(21) Appl. No.: 15/595,168

(22) Filed: May 15, 2017

(65) Prior Publication Data

US 2018/0330745 A1 Nov. 15, 2018

(51) Int. Cl.

| | |
|---|---|
| ***H04R 3/00*** | (2006.01) |
| ***G10L 21/0264*** | (2013.01) |
| ***H04R 1/40*** | (2006.01) |
| ***G10L 19/005*** | (2013.01) |
| ***G10L 21/0208*** | (2013.01) |

(Continued)

(52) U.S. Cl.

CPC ..... *G10L 21/0264* (2013.01); *G10L 19/005* (2013.01); *G10L 21/0208* (2013.01); *H04R 1/1083* (2013.01); *H04R 1/406* (2013.01); *H04R 3/005* (2013.01); *G10L 25/78* (2013.01); *G10L 2021/02165* (2013.01); *G10L 2021/02166* (2013.01); *H04R 2201/40* (2013.01); *H04R 2430/23* (2013.01); *H04R 2460/01* (2013.01)

(58) Field of Classification Search

CPC ..... H04R 3/00

See application file for complete search history.

(56) References Cited

U.S. PATENT DOCUMENTS

| | | | |
|---|---|---|---|
| 7,492,889 | B2 | 2/2009 | Ebenezer |
| 8,565,446 | B1 | 10/2013 | Ebenezer |

(Continued)

FOREIGN PATENT DOCUMENTS

| | | | |
|---|---|---|---|
| EP | 2723054 | A | 4/2014 |
| WO | 2012061148 | A1 | 5/2012 |

OTHER PUBLICATIONS

Ebenezer, S.P., "Robust Nullformer", Cirrus Logic Innovation Conference, Edinburg, UK, 2015.

(Continued)

*Primary Examiner* — Olisa Anwah

(74) *Attorney, Agent, or Firm* — Jackson Walker L.L.P.

(57) ABSTRACT

In accordance with embodiments of the present disclosure, a method for voice processing in an audio device having an array of a plurality of microphones wherein the array is capable of having a plurality of positional orientations relative to a user of the array, is provided. The method may include periodically computing a plurality of normalized cross-correlation functions, each cross-correlation function corresponding to a possible orientation of the array with respect to a desired source of speech, determining an orientation of the array relative to the desired source based on the plurality of normalized cross-correlation functions, detecting changes in the orientation based on the plurality of normalized cross-correlation functions, and responsive to a change in the orientation, dynamically modifying voice processing parameters of the audio device such that speech from the desired source is preserved while reducing interfering sounds.

38 Claims, 15 Drawing Sheets

(51) Int. Cl.

| | |
|---|---|
| ***H04R 1/10*** | (2006.01) |
| *G10L 25/78* | (2013.01) |
| *G10L 21/0216* | (2013.01) |

(56) References Cited

U.S. PATENT DOCUMENTS

| | | | | |
|---|---|---|---|---|
| 9,479,885 | B1 | 10/2016 | Ivanov et al. | |
| 9,532,138 | B1 | 12/2016 | Allen | |
| 9,980,075 | B1 * | 5/2018 | Benattar | H04S 7/303 |
| 2010/0014690 | A1 * | 1/2010 | Wolff | H04R 3/005 381/92 |
| 2010/0329479 | A1 | 12/2010 | Nakadai et al. | |
| 2014/0093091 | A1 * | 4/2014 | Dusan | H04R 1/1083 381/74 |
| 2016/0269849 | A1 * | 9/2016 | Riggs | H04S 7/304 |
| 2017/0092256 | A1 | 3/2017 | Ebenezer | |
| 2017/0118555 | A1 | 4/2017 | Ebenezer | |

OTHER PUBLICATIONS

Ebenezer, S.P., "Near Field Analysis Report", Acoustic Technologies, Inc., Jul. 7, 2011.

International Search Report and Written Opinion of the International Searching Authority, International Application No. PCT/US2018/032180, dated Aug. 21, 2018.

Combined Search and Examination Report under Sections 17 and 18(3), UKIPO, Application No. 17098855.9, dated Dec. 20, 2017.

* cited by examiner

DUAL MICROPHONE VOICE PROCESSING FOR HEADSETS WITH VARIABLE MICROPHONE ARRAY ORIENTATION

TECHNICAL FIELD

The field of representative embodiments of this disclosure relates to methods, apparatuses, and implementations concerning or relating to voice applications in an audio device. Applications include dual microphone voice processing for headsets with a variable microphone array orientation relative to a source of desired speech.

BACKGROUND

Voice activity detection (VAD), also known as speech activity detection or speech detection, is a technique used in speech processing in which the presence or absence of human speech is detected. VAD may be used in a variety of applications, including noise suppressors, background noise estimators, adaptive beamformers, dynamic beam steering, always-on voice detection, and conversation-based playback management. Many voice activity detection applications may employ a dual-microphone-based speech enhancement and/or noise reduction algorithm, that may be used, for example, during a voice communication, such as a call. Most traditional dual microphone algorithms assume that an orientation of the array of microphones with respect to a desired source of sound (e.g., a user's mouth) is fixed and known a priori. Such prior knowledge of this array position with respect to the desired sound source may be exploited to preserve a user's speech while reducing interference signals coming from other directions.

Headsets with a dual microphone array may come in a number of different sizes and shapes. Due to the small size of some headsets, such as in-ear fitness headsets, headsets may have limited space in which to place the dual microphone array on an earbud itself. Moreover, placing microphones close to a receiver in the earbud may introduce echo-related problems. Hence, many in-ear headsets often include a microphone placed on a volume control box for the headset and a single microphone-based noise reduction algorithm is used during voice call processing. In this approach, voice quality may suffer when a medium to high level of background noise is present. The use of dual microphones assembled in the volume control box may improve the noise reduction performance. In a fitness-type headset, the control box may frequently move and the control box position with respect to a user's mouth can be at any point in space depending on user preference, user movement, or other factors. For example, in a noisy environment, the user may manually place the control box close to the mouth for increased input signal-to-noise ratio. In such cases, using a dual microphone approach for voice processing in which the microphones are placed in the control box may be a challenging task.

SUMMARY

In accordance with the teachings of the present disclosure, one or more disadvantages and problems associated with existing approaches to voice processing in headsets may be reduced or eliminated.

In accordance with embodiments of the present disclosure, a method for voice processing in an audio device having an array of a plurality of microphones, wherein the array is capable of having a plurality of positional orientations relative to a user of the array, is provided. The method may include periodically computing a plurality of normalized cross-correlation functions, each cross-correlation function corresponding to a possible orientation of the array with respect to a desired source of speech, determining an orientation of the array relative to the desired source based on the plurality of normalized cross-correlation functions, detecting changes in the orientation based on the plurality of normalized cross-correlation functions, and responsive to a change in the orientation, dynamically modifying voice processing parameters of the audio device such that speech from the desired source is preserved while reducing interfering sounds.

In accordance with these and other embodiments of the present disclosure, an integrated circuit for implementing at least a portion of an audio device may include an audio output configured to reproduce audio information by generating an audio output signal for communication to at least one transducer of the audio device, an array of a plurality of microphones wherein the array is capable of having a plurality of positional orientations relative to a user of the array, and a processor configured to implement a near-field detector. The processor may be configured to periodically compute a plurality of normalized cross-correlation functions, each cross-correlation function corresponding to a possible orientation of the array with respect to a desired source of speech, determine an orientation of the array relative to the desired source based on the plurality of normalized cross-correlation functions, detect changes in the orientation based on the plurality of normalized cross-correlation functions, and responsive to a change in the orientation, dynamically modify voice processing parameters of the audio device such that speech from the desired source is preserved while reducing interfering sounds.

Technical advantages of the present disclosure may be readily apparent to one of ordinary skill in the art from the figures, description, and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the example, present embodiments and certain advantages thereof may be acquired by referring to the following description taken in conjunction with the accompanying drawings, in which like reference numbers indicate like features, and wherein.

DETAILED DESCRIPTION

In this disclosure, systems and methods are proposed for voice processing with a dual microphone array that is robust to any changes in the control box position with respect to a desired source of sound (e.g., a user's mouth). Specifically, systems and methods for tracking direction of arrival using a dual microphone array are disclosed. Furthermore, the systems and methods herein include using correlation based near-field test statistics to accurately track direction of arrival without any false alarms to avoid false switching. Such spatial statistics may then be used to dynamically modify a speech enhancement process.

Figure 1:
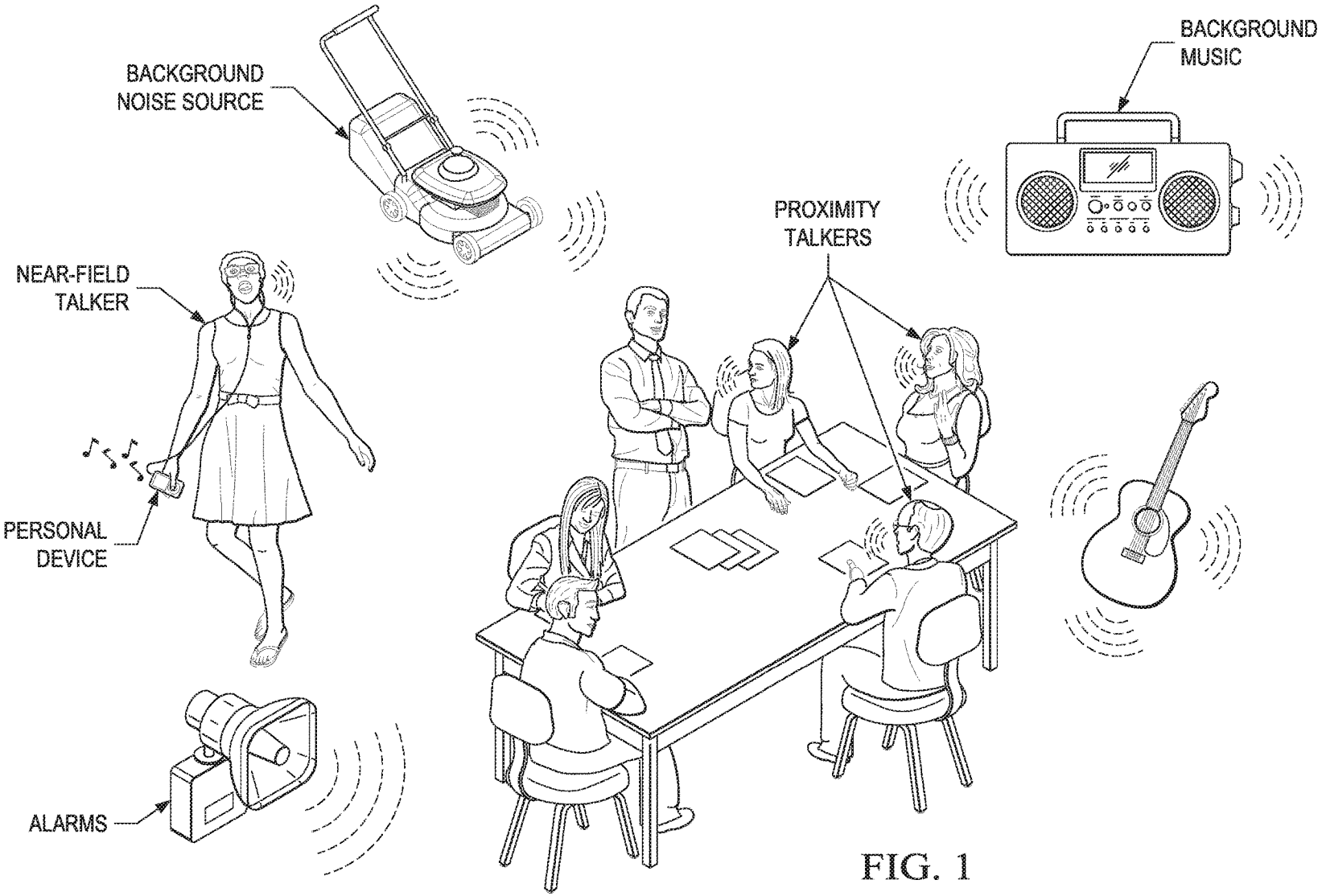
FIG. 1 illustrates an example of a use case scenario wherein various detectors may be used in conjunction with a playback management system to enhance a user experience, in accordance with embodiments of the present disclosure.

In accordance with embodiments of this disclosure, an automatic playback management framework may use one or more audio event detectors. Such audio event detectors for an audio device may include a near-field detector that may detect when sounds in the near-field of the audio device are detected, such as when a user of the audio device (e.g., a user that is wearing or otherwise using the audio device) speaks, a proximity detector that may detect when sounds in proximity to the audio device are detected, such as when another person in proximity to the user of the audio device speaks, and a tonal alarm detector that detects acoustic alarms that may have been originated in the vicinity of the audio device. FIG. 1 illustrates an example of a use case scenario wherein such detectors may be used in conjunction with a playback management system to enhance a user experience, in accordance with embodiments of the present disclosure.

Figure 2:
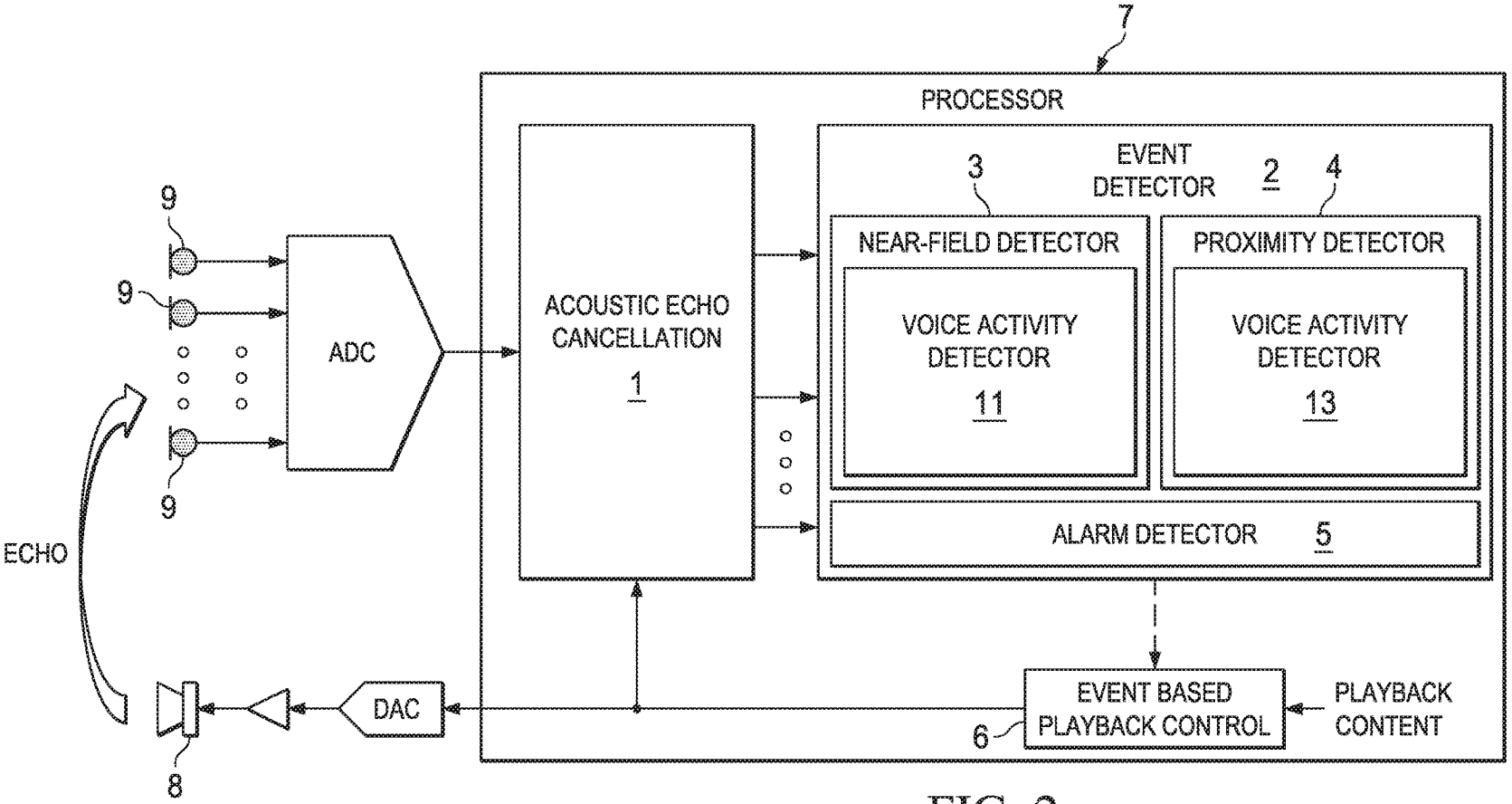
FIG. 2 illustrates an example playback management system, in accordance with embodiments of the present disclosure.

FIG. 2 illustrates an example playback management system that modifies a playback signal based on a decision from an event detector 2, in accordance with embodiments of the present disclosure. Signal processing functionality in a processor 7 may comprise an acoustic echo canceller 1 that may cancel an acoustic echo that is received at microphones 9 due to an echo coupling between an output audio transducer 8 (e.g., loudspeaker) and microphones 9. The echo reduced signal may be communicated to event detector 2 which may detect one or more various ambient events, including without limitation a near-field event (e.g., including but not limited to speech from a user of an audio device) detected by near-field detector 3, a proximity event (e.g., including but not limited to speech or other ambient sound other than near-field sound) detected by proximity detector 4, and/or a tonal alarm event detected by alarm detector 5. If an audio event is detected, an event-based playback control 6 may modify a characteristic of audio information (shown as "playback content" in FIG. 2) reproduced to output audio transducer 8. Audio information may include any information that may be reproduced at output audio transducer 8, including without limitation, downlink speech associated with a telephonic conversation received via a communication network (e.g., a cellular network) and/or internal audio from an internal audio source (e.g., music file, video file, etc.).

As shown in FIG. 2, near-field detector 3 may include a voice activity detector 11 which may be utilized by near-field detector 3 to detect near-field events. Voice activity detector 11 may include any suitable system, device, or apparatus configured to perform speech processing to detect the presence or absence of human speech. In accordance with such processing, voice activity detector 11 may detect the presence of near-field speech.

As shown in FIG. 2, proximity detector 4 may include a voice activity detector 13 which may be utilized by proximity detector 4 to detect events in proximity with an audio device. Similar to voice activity detector 11, voice activity detector 13 may include any suitable system, device, or apparatus configured to perform speech processing to detect the presence or absence of human speech.

Figure 3:
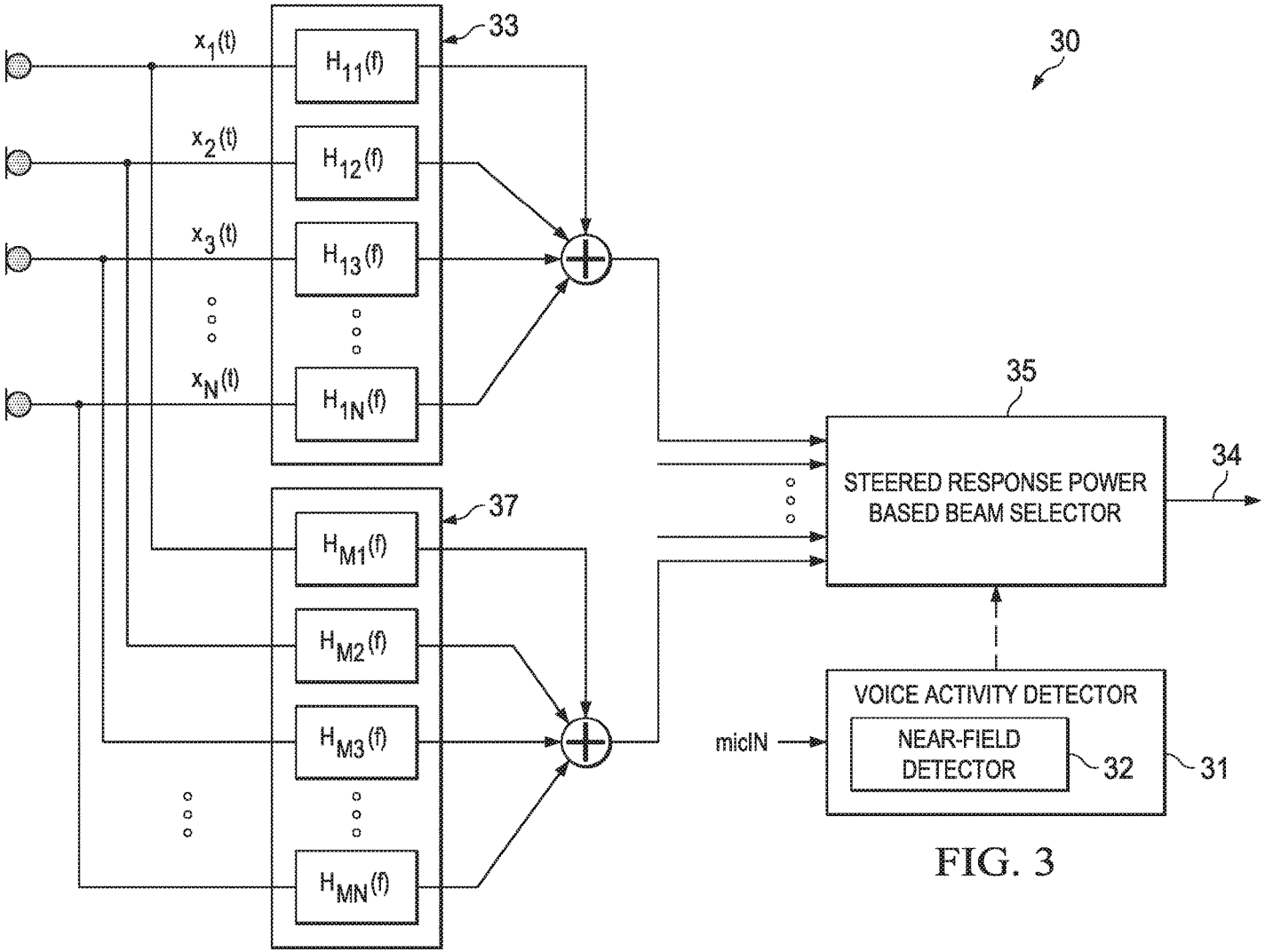
FIG. 3 illustrates an example steered response power based beamsteering system, in accordance with embodiments of the present disclosure.

FIG. 3 illustrates an example steered response power-based beamsteering system 30, in accordance with embodiments of the present disclosure. Steered response power-based beamsteering system 30 may operate by implementing multiple beamformers 33 (e.g., delay-and-sum and/or filter-and-sum beamformers) each with a different look direction such that the entire bank of beamformers 33 will cover the desired field of interest. The beamwidth of each beamformer 33 may depend on a microphone array aperture length. An output power from each beamformer 33 may be computed, and a beamformer 33 having a maximum output power may be switched to an output path 34 by a steered-response power-based beam selector 35. Switching of beam selector 35 may be constrained by a voice activity detector 31 having a near-field detector 32 such that the output power is measured by beam selector 35 only when speech is detected, thus preventing beam selector 35 from rapidly switching between multiple beamformers 33 by responding to spatially non-stationary background impulsive noises.

Figure 4:
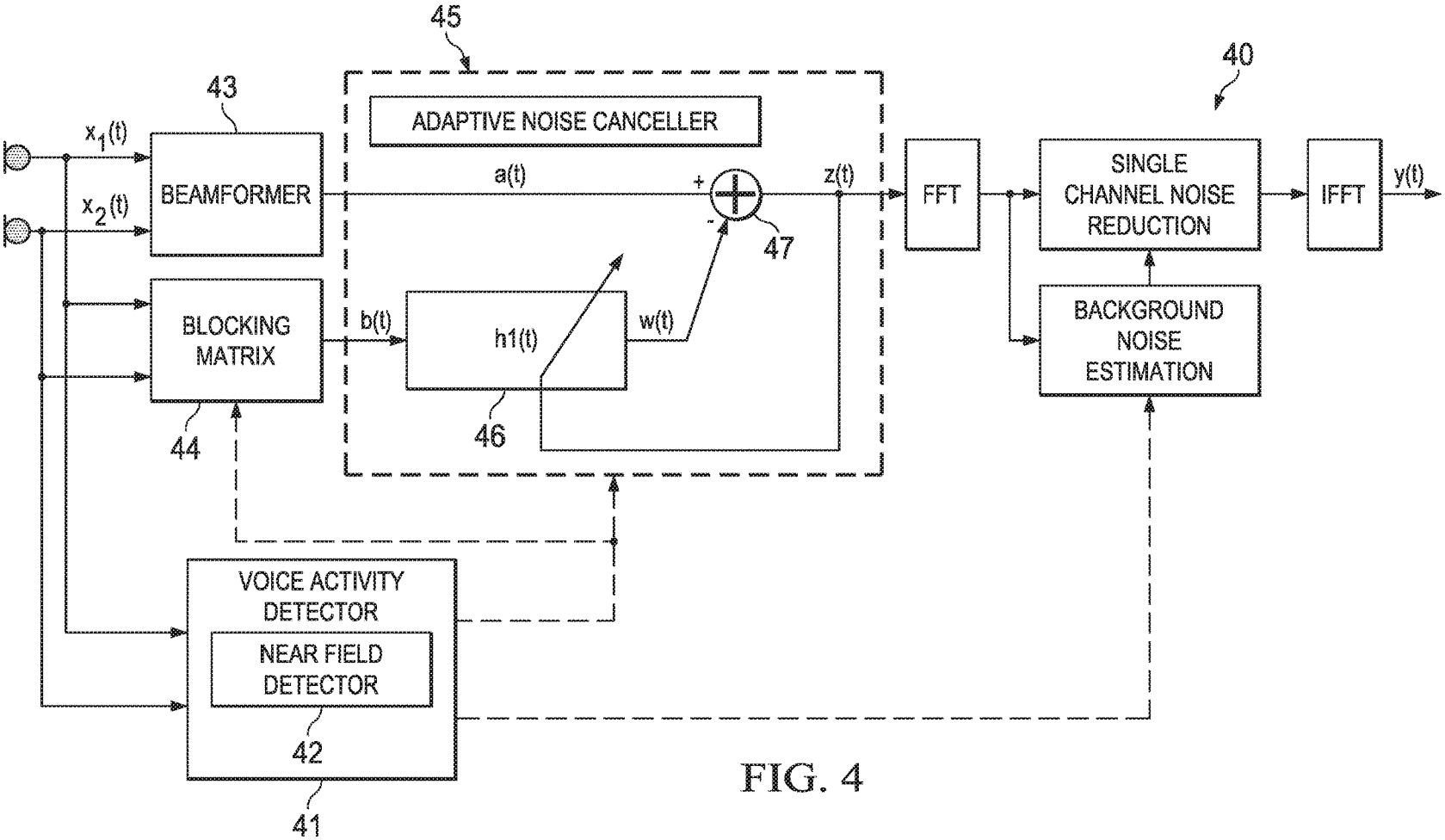
FIG. 4 illustrates an example adaptive beamformer, in accordance with embodiments of the present disclosure.

FIG. 4 illustrates an example adaptive beamformer 40, in accordance with embodiments of the present disclosure. Adaptive beamformer 40 may comprise any system, device, or apparatus capable of adapting to changing noise conditions based on received data. In general, an adaptive beamformer may achieve higher noise cancellation or interference suppression compared to fixed beamformers. As shown in FIG. 4, adaptive beamformer 40 is implemented as a generalized side lobe canceller (GSC). Accordingly, adaptive beamformer 40 may comprise a fixed beamformer 43, blocking matrix 44, and a multiple-input adaptive noise canceller 45 comprising an adaptive filter 46. If adaptive filter 46 were to adapt at all times, it may train to speech leakage also causing speech distortion during a subtraction stage 47. To increase robustness of adaptive beamformer 40, a voice activity detector 41 having a near-field detector 42 may communicate a control signal to adaptive filter 46 to disable training or adaptation in the presence of speech. In such implementations, voice activity detector 41 may control a noise estimation period wherein background noise is not estimated whenever speech is present. Similarly, the robustness of a GSC to speech leakage may be further improved by using an adaptive blocking matrix, the control for which may include an improved voice activity detector with an impulsive noise detector, as described in U.S. Pat. No. 9,607,603 entitled "Adaptive Block Matrix Using Pre-Whitening for Adaptive Beam Forming."

Figure 5:
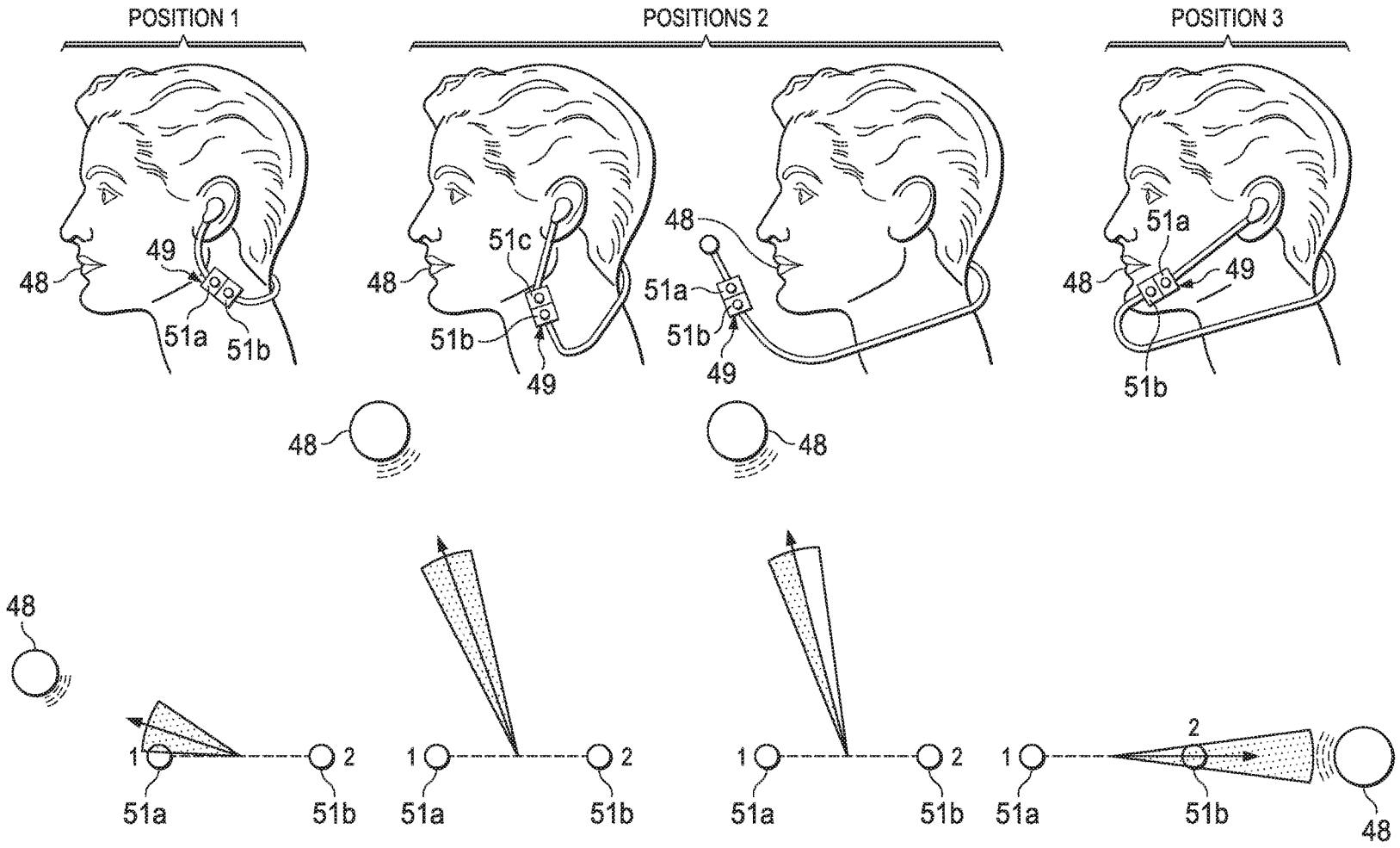
FIG. 5 illustrates a schematic showing a variety of possible orientations of microphones in a fitness headset, in accordance with embodiments of the present disclosure.

FIG. 5 illustrates a schematic showing a variety of possible orientations of microphones 51 (e.g., 51*a*, 51*b*) in a fitness headset 49 relative to a user's mouth 48, wherein the user's mouth is the desired source of voice-related sound, in accordance with embodiments of the present disclosure.

Figure 6:
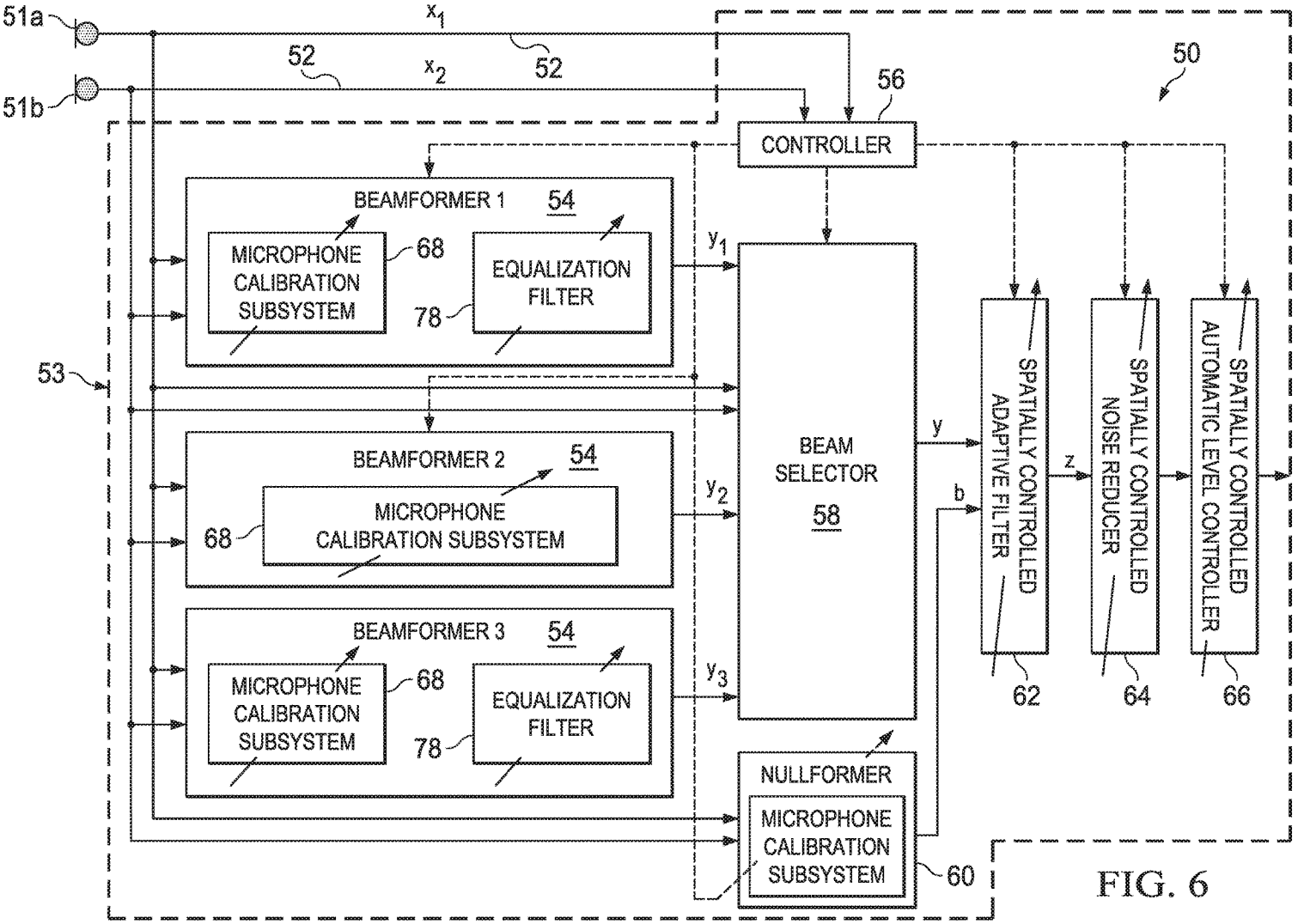
FIG. 6 illustrates a block diagram of selected components of an audio device for implementing dual-microphone voice processing for a headset with a variable microphone array orientation, in accordance with embodiments of the present disclosure.

FIG. 6 illustrates a block diagram of selected components of an audio device 50 for implementing dual-microphone voice processing for a headset with a variable microphone array orientation, in accordance with embodiments of the present disclosure. As shown, audio device 50 may include microphone inputs 52 and a processor 53. A microphone input 52 may include any electrical node configured to receive an electrical signal (e.g., $x_1$, $x_2$) indicative of acoustic pressure upon a microphone 51. In some embodiments, such electrical signals may be generated by respective microphones 51 located on a controller box (sometimes known as a communications box) associated with an audio headset. Processor 53 may be communicatively coupled to microphone inputs 52 and may be configured to receive the electrical signals generated by microphones 51 coupled to microphone inputs 52 and process such signals to perform voice processing, as further detailed herein. Although not shown for the purposes of descriptive clarity, a respective analog-to-digital converter may be coupled between each of the microphones 51 and their respective microphone inputs 52 in order to convert analog signals generated by such microphones into corresponding digital signals which may be processed by processor 53.

As shown in FIG. 6, processor 53 may implement a plurality of beamformers 54, a controller 56, a beam selector 58, a null former 60, a spatially-controlled adaptive filter 62, a spatially-controlled noise reducer 64, and a spatially-controlled automatic level controller 66.

Beamformers 54 may comprise microphone inputs corresponding to microphone inputs 52 that may generate a plurality of beams based on microphone signals (e.g., $x_1$, $x_2$) received by such inputs. Each of the plurality of beamformers 54 may be configured to form a respective one of a plurality of beams to spatially filter audible sounds from microphones 51 coupled to microphone inputs 52. In some embodiments, each beam former 54 may comprise a unidirectional beamformer configured to form a respective unidirectional beam in a desired look direction to receive and spatially filter audible sounds from microphones 51 coupled to microphone inputs 52, wherein each such respective unidirectional beam may have a spatial null in a direction different from that of all other unidirectional beams formed by other unidirectional beamformers 54, such that the beams formed by unidirectional beamformers 54 all have a different look direction.

In some embodiments, beamformers 54 may be implemented as time-domain beamformers. The various beams formed by beamformers 54 may be formed at all times during operation. While FIG. 6 depicts processor 53 as implementing three beamformers 54, it is noted that any suitable number of beams may be formed from microphones 51 coupled to microphone inputs 52. Furthermore, it is noted that a voice processing system in accordance with this disclosure may comprise any suitable number of microphones 51, microphone inputs 52, and beamformers 54.

For a dual microphone array such as that depicted in FIG. 6, performance of beam former 54 in a diffuse noise field may be optimum only when the spatial diversity of microphones 51 is maximized. The spatial diversity may be maximized when the time difference of arrival of desired speech between the two microphones 51 coupled to microphone inputs 52 is maximized. In the three beam former implementation shown in FIG. 6, the time difference of arrival for beam former 2 may usually be small and the signal-to-noise ratio (SNR) improvement from beam former 2 may thus be limited. For beamformers 1 and 3, the beam former position may be maximized when the desired speech arrives from either end of an array of microphones 51 (e.g., "endfire"). Therefore, in the three beam former example shown in FIG. 6, beamformers 1 and 3 may be implemented using delay and difference beamformers and beam former 2 may be implemented using a delay and sum beam former. Such choice of beamformers 54 may optimally align beam former performance to the desired signal arrival direction.

For optimal performance and to provide room for manufacturing tolerances of microphones coupled to microphone inputs 52, beamformers 54 may each include a microphone calibration subsystem 68 in order to calibrate the input signals (e.g., $x_1$, $x_2$) before mixing the two microphone signals. For example, a microphone signal level difference may be caused by differences in the microphone sensitivity and the associated microphone assembly/booting differences. A near-field propagation loss effect caused by the close proximity of a desired source of sound to the microphone array may also introduce microphone-level differences. The degree of such near-field effect may vary based on different microphone orientations relative to the desired source. Such near-field effect may also be exploited to detect the orientation of the array of microphones 51, as described further below.

Figure 7:
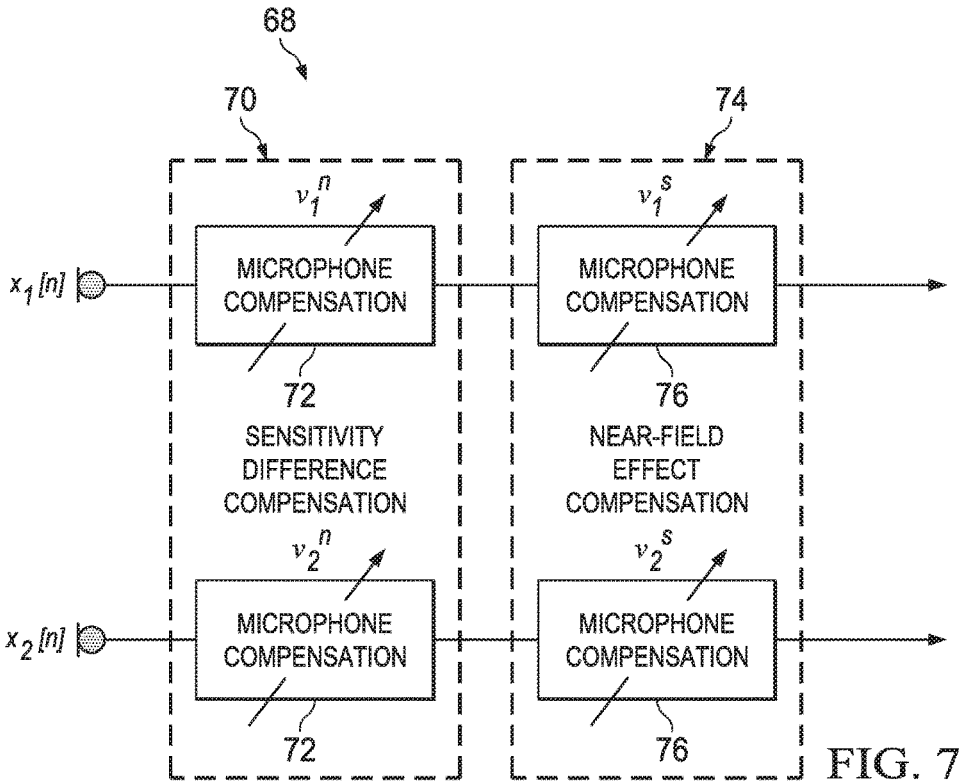
FIG. 7 illustrates a block diagram of selected components of a microphone calibration subsystem, in accordance with embodiments of the present disclosure.

Turning briefly to FIG. 7, FIG. 7 illustrates a block diagram of selected components of a microphone calibration subsystem 68, in accordance with embodiments of the present disclosure. As shown in FIG. 7, microphone calibration subsystem 68 may be split into two separate calibration blocks. A first block 70 may compensate for sensitivity differences between individual microphone channels, and calibration gains applied to microphone signals in block 70 (e.g., by microphone compensation blocks 72) may be updated only when correlated diffuse and/or far-field noise is present. A second block 74 may compensate for near-field effects and the corresponding calibration gains applied to microphone signals in block 74 (e.g., by microphone compensation blocks 76) may be updated only when the desired speech is detected. Accordingly, turning again to FIG. 6, beamformers 54 may mix the compensated microphone signals and may generate beam former outputs as:

Beam former 1 (delay and difference):

$$y_1[n]=v_1^n[n]x_1[n]-v_2^n[n]x_2[n-n_2^1]$$

Beam former 2 (delay and sum):

$$y_2[n]=v_1^n[n]x_1[n-n_1^2]+v_2^n[n]x_2[n-n_2^2]$$

Beam former 3 (delay and difference):

$$y_3[n]=v_1^n[n]x_1[n-n_1^3]-v_2^n[n]x_2[n]$$

where $n_2^1$ is the time difference of arrival between microphone 51*b* and microphone 51*a* for an interfering signal source located closer to microphone 51*b*, $n_1^3$ is the time difference of arrival between microphone 51*a* and microphone 51*b* for an interfering signal source located closer to microphone 51*a*, and $n_1^2$ and $n_2^2$ are the time delays necessary to time align the signal arriving from position 2 shown in FIG. 5, for example, with broadside position, $n_1^2=n_2^2=0$. Beamformers 54 may calculate such time delays as:

$$n_2^1=\frac{d\ \sin(\dot{\varphi})}{cF_s}$$

$$n_1^3=\frac{d\ \sin(\dot{\theta})}{cF_s}$$

where d is the spacing between microphones 51, c is the speed of sound, $F_s$, is the sampling frequency and $\dot{\varphi}$ and $\dot{\theta}$ are the dominant interfering signals arriving in the look directions of beamformers 1 and 3, respectively.

Delay and difference beamformers (e.g., beamformers 1 and 3) may suffer from a high pass filtering effect, and a cut-off frequency and a stop band suppression may be affected by microphone spacing, look direction, null-direction, and the propagation loss difference due to near-field effects. This high pass filtering effect may be compensated by applying a low pass equalization filter 78 at the respective outputs of beamformers 1 and 3. The frequency response of low pass equalization filter 78 may be given by:

$$H_{eq}(f)=\frac{2}{\left|\exp\left\{\frac{j2\pi fd\ \sin(\ddot{\varphi})}{c}\right\}-\ddot{\gamma}\ \exp\left\{\frac{j2\pi fd\ \sin(\ddot{\theta})}{c}\right\}\right|}$$

where $\ddot{\gamma}$ is the near-field propagation loss difference which can be estimated from calibration subsystem 68, $\ddot{\theta}$ is the look direction towards which the beam is focused and $\ddot{\varphi}$ is the null direction from which the interference is expected to arrive. A direction of arrival estimate doa and near-field controls generated by controller 56, as described in greater detail below, may be used to dynamically set position-specific beam former parameters. An alternative architecture may include a fixed beam former followed by an adaptive spatial filter to enhance noise cancellation performance in a dynamically varying noise field. As a specific example, the look and null directions for beam former 1 may be set to −90° and 30°, respectively, and for beam former 3, the corresponding angular parameters may be set to 90° and 30°, respectively. The look direction for beam former 2 may be set at 0° which may provide a signal-to-noise ratio improvement in a non-coherent noise field. It is noted a position of the microphone array corresponding to the look direction of beam former 3 may have close proximity to a desired source of sound (e.g., the user's mouth) and thus, the frequency response of the low pass equalization filters 78 may be set differently for beamformers 1 and 3.

Figure 8:
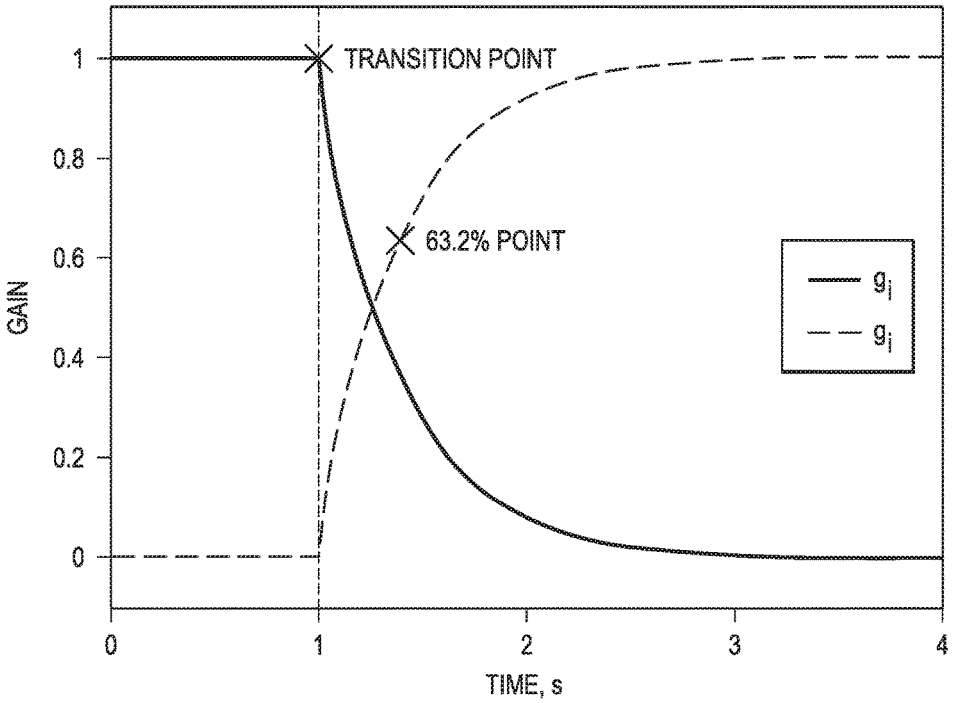
FIG. 8 illustrates a graph depicting an example gain mixing scheme for beamformers, in accordance with the present disclosure.

Beam selector 58 may include any suitable system, device, or apparatus configured to receive the simultaneously formed plurality of beams from beamformers 54, and, based on one or more control signals from controller 56, select which of the simultaneously-formed beams will be output to spatially-controlled adaptive filter 62. In addition, whenever a change in a detected orientation of the microphone array occurs in which the selected beam former 54 changes, beam selector 58 may also transition between the selection by mixing outputs of beamformers 54, in order to make artifacts caused by such a transition between beams. Accordingly, beam selector 58 may include a gain block for each of the outputs of beamformers 54 and the gains applied to outputs may be modified over a period of time to ensure smooth mixing of beam former outputs as beam selector 58 transitions from one selected beam former 54 to another selected beam former 54. An example approach to achieve such smoothing may be to use a simple recursive averaging filter based method. Specifically, if i and j are the headset positions before and after the array orientation change, respectively, and the corresponding gains just before the switch are 1 and 0 respectively, then the gains for these two beamformers 54 may be, during the transition of selection between such beamformers 54, modified as:

$$g_i[n]=\delta_g g_i[n]$$

$$g_j[n]=\delta_g g_j[n]+(1-\delta_9)$$

where $\delta_g$ is a smoothing constant that controls a ramp time for the gain. The parameter $\delta_g$ may define a time required to reach 63.2% of the final steady state gain. It is important to note that the sum of these two gain values is maintained to one at any moment in time thereby ensuring energy preservation for equal energy input signals. FIG. 8 illustrates a graph plot depicting such gain mixing scheme, in accordance with the present disclosure.

Figure 9:
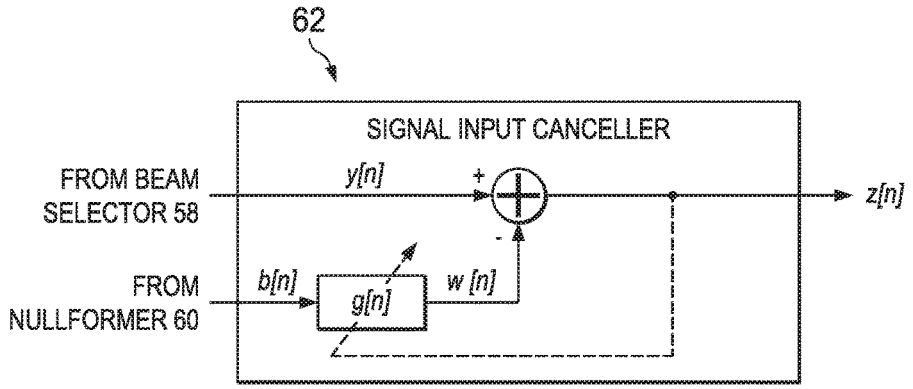
FIG. 9 illustrates a block diagram of selected components of an example spatially-controlled adaptive filter, in accordance with embodiments of the present disclosure.

Any signal-to-noise ratio (SNR) improvement from the selected fixed beam former 54 may be optimum in a diffuse noise field. However, the SNR improvement may be limited if the directional interfering noise is spatially non-stationary. To improve SNR, processor 53 may implement spatially-controlled adaptive filter 62. Turning briefly to FIG. 9, FIG. 9 illustrates a block diagram of selected components of an example spatially-controlled adaptive filter 62, in accordance with embodiments of the present disclosure. In operation, spatially-controlled adaptive filter 62 may have the ability to dynamically steer a null of a selected beam former 54 towards a dominant directional interfering noise. The filter coefficients of the spatially-controlled adaptive filter 62 may be updated only when desired speech is not detected. A reference signal to spatially-controlled adaptive filter 62 is generated by combining the two microphone signals $x_1$ and $x_2$ such that the reference signal b[n] includes as little desired speech signal as possible to avoid speech suppression. Nullformer 60 may generate reference signal b[n] with a null focused towards a desired speech direction. Nullformer 60 may generate reference signal b[n] as:

For position 1 shown in FIG. 5 (delay and difference):

$$b[n]=v_1^n[n]v_1^s[n]x_1[n-m_1^1]-v_2^n[n]v_2^s[n]x_2[n]$$

For position 2 shown in FIG. 5 (delay and difference):

$$b[n]=v_1^n[n]v_1^s[n]x_1[n-n_1^2]-v_2^n[n]v_2^s[n]x_2[n-n_2^2]$$

For position 3 shown in FIG. 5 (delay and difference):

$$b[n]=v_1^n[n]v_1^s[n]x_1[n]-v_2^n[n]v_2^s[n]x_2[n-m_2^3]$$

where $v_1^s[n]$ and $v_2^s[n]$ are calibration gains compensating for near-field propagation loss effects (described in greater detail below) wherein such calibrated values may be different for various headset positions, and wherein:

$$m_1^1 = \frac{d\ \sin(\theta)}{cF_s}$$

$$m_2^3 = \frac{d\ \sin(\varphi)}{cF_s}$$

where θ and φ are a desired signal direction in positions 1 and 3, respectively. Nullformer 60 includes two calibration gains to reduce desired speech leakage of the noise reference signal. Nullformer 60 in position 2 may be a delay and difference beam former and it may use the same time delays that are used in a front-end beam former 54. Alternatively to a single nullformer 60, a bank of nullformers similar to the front-end beamformers 54 may also be used. In other alternative embodiments, other nullformer implementations may be used.

Figure 10:
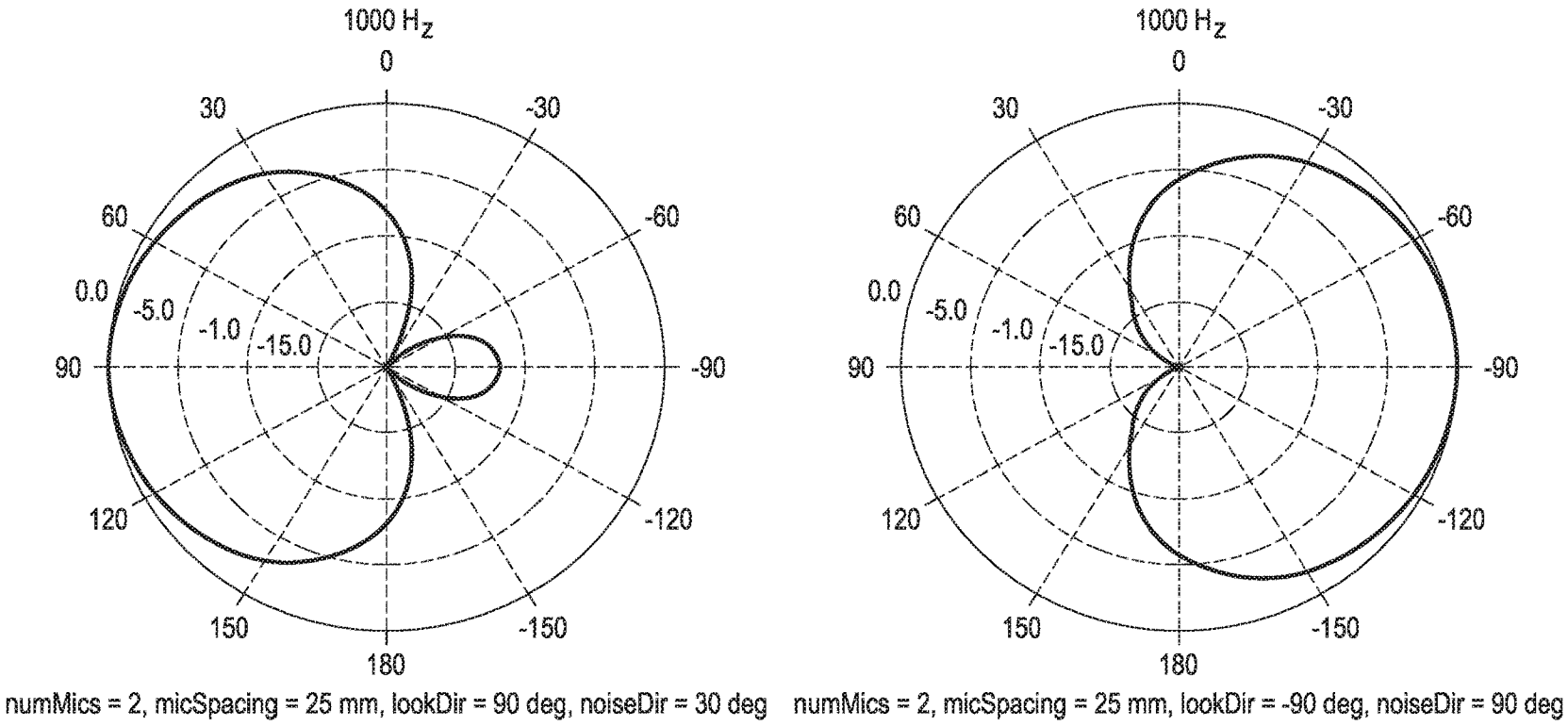
FIG. 10 illustrates a graph depicting an example of beam patterns corresponding to a particular orientation of a microphone array, in accordance with the present disclosure.

As an illustrative example, beam patterns corresponding to position 3 of FIG. 5 (e.g., desired speech arriving from an angle of 90°) for a selected fixed front-end beam former 54 and noise reference nullformer 60 is depicted in FIG. 10. In operation, nullformer 60 may be adaptive in that it may dynamically modify its null as the desired speech direction is varied.

Figure 11:
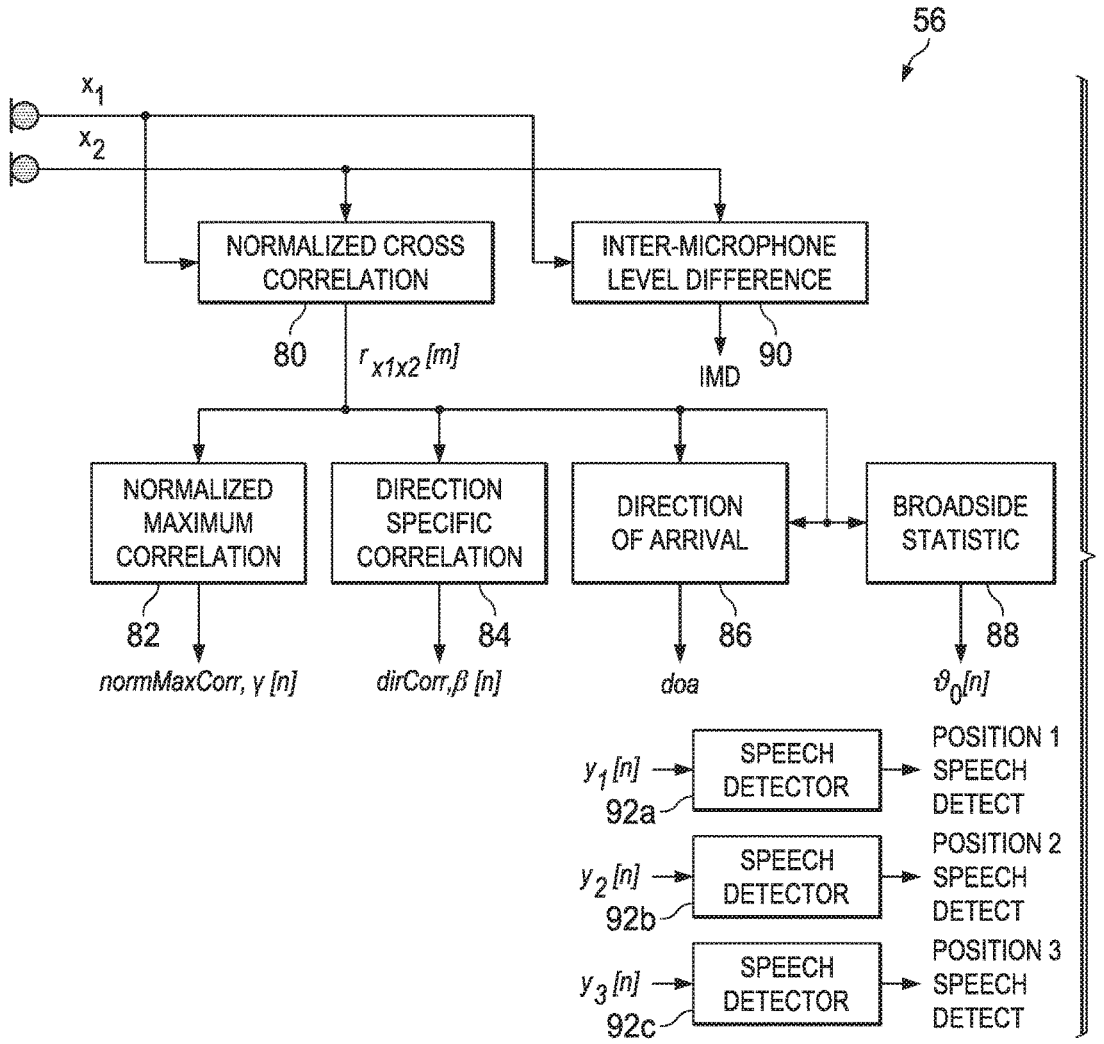
FIG. 11 illustrates selected components of an example controller, in accordance with embodiments of the present disclosure.

FIG. 11 illustrates selected components of an example controller 56, in accordance with embodiments of the present disclosure. As shown in FIG. 11, controller 56 may implement a normalized cross-correlation block 80, a normalized maximum correlation block 82, a direction-specific correlation block 84, a direction of arrival block 86, a broadside statistic block 88, an inter-microphone level difference block 90, and a plurality of speech detectors 92 (e.g., speech detectors 92*a*, 92*b*, and 92*c*).

When an acoustic source is close to a microphone 51, a direct-to-reverberant signal ratio for such microphone may usually be high. The direct-to-reverberant ratio may depend on a reverberation time ($RT_{60}$) of the room/enclosure and other physical structures that are in the path between a near-field source and a microphone 51. When the distance between the source and microphone 51 increases, the direct-to-reverberant ratio may decrease due to propagation loss in the direct path, and the energy of the reverberant signal may be comparable to the direct path signal. Such concept may be used by components of controller 56 to derive a valuable statistic that will indicate the presence of a near-field signal that is robust to array position. Normalized cross-correlation block 80 may compute a cross-correlation sequence between microphones 51 as:

$$r_{x1x2}[m] = \frac{1}{N}\sum_{n=0}^{N-1} x_1[n]x_2[n-m]$$

wherein the range of m:

$$\left[\text{ceil}\left(\frac{d}{c}F_S\right), \text{floor}\left(\frac{d}{c}F_S\right)\right].$$

Normalized maximum correlation block 82 may use the cross-correlation sequence to compute a maximum normalized correlation statistic as:

$$\tilde{\gamma} = \max_{\forall m}\left\{\frac{r_{x1x2}[m]}{\sqrt{E_{x1}E_{x2}}}\right\}$$

where $E_{xi}$ correspond to $i^{th}$ microphone energy. Normalized maximum correlation block 82 may also apply smoothing to this result to generate a normalized maximum correlation statistic normMaxCorr as:

$$\gamma[n]=\delta_\gamma n-1]+(1-\delta_\gamma)\tilde{\gamma}[n]$$

where $\delta_\gamma$ is a smoothing constant.

Figure 12:
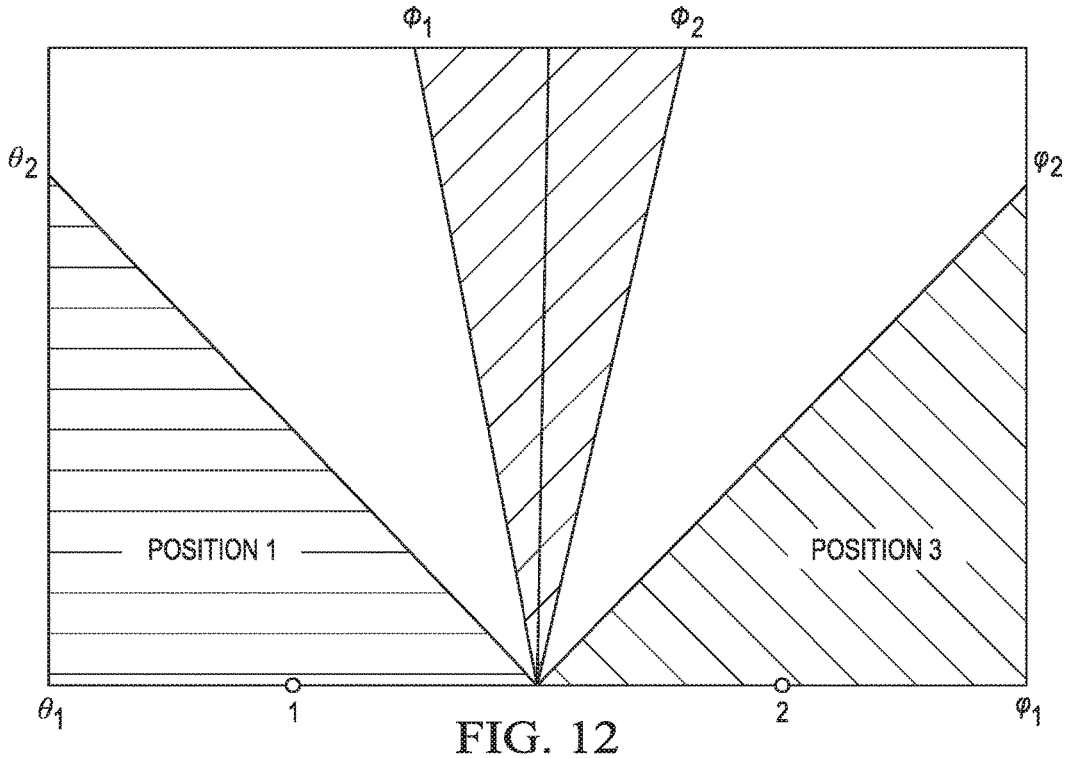
FIG. 12 illustrates a diagram depicting example possible directional ranges of a dual microphone array, in accordance with embodiments of the present disclosure.

Direction specific correlation block 84 may be able to compute a direction specific correlation statistic dirCorr required to detect speech from positions 1 and 3 as shown in FIG. 12 as follows. First, direction specific correlation block 84 may determine a maximum of the normalized cross-correlation function within different directional regions:

$$l_1[n] = \max_{m\in f([\theta_1\ \theta_2])}\{r_{x1x2}[m]\}$$

$$l_2[n] = \max_{m\in f([\varphi_1\ \varphi_2])}\{r_{x1x2}[m]\}$$

$$l_3[n] = \max_{m\in f([\phi_1\ \phi_2])}\{r_{x1x2}[m]\}$$

$$\gamma_i[n] = \frac{r_{x1x2}[l_i]}{\sqrt{E_{x1}E_{x2}}},\ i = 1, 2, 3$$

Second, direction specific correlation block 84 may determine a maximum deviation between the directional correlation statistics as follows:

$$\beta_1[n]=\max\{|\gamma_2[n]-\gamma_1[n]|,|\gamma_3[n]-\gamma_1[n]|\}$$

$$\beta_2[n]=\max\{|\gamma_1[n]-\gamma_2[n]|,|\gamma_3[n]-\gamma_2[n]|\}$$

Finally, direction specific correlation block 84 may compute direction specific correlation statistic dirCorr as follows:

$$\beta[n]=\beta_2[n]-\beta_1[n]$$

Figure 13:
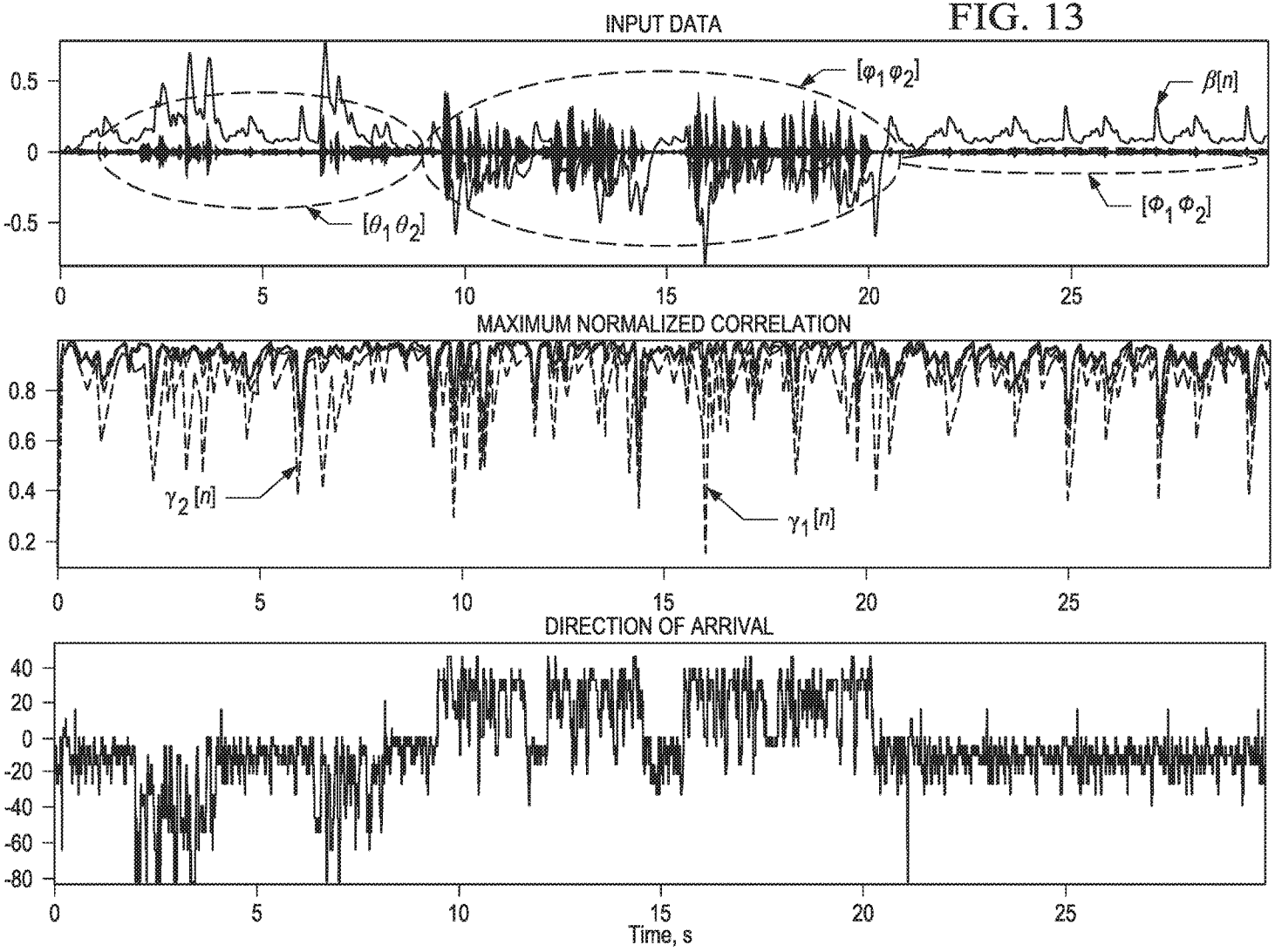
FIG. 13 illustrates a graph depicting a direction specific correlation statistic obtained from a dual microphone array with speech arriving from positions 1 and 3 shown in FIG. 5, in accordance with embodiments of the present disclosure.

FIG. 13 illustrates a graph showing direction specific correlation statistic dirCorr obtained from a dual microphone array with speech arriving from positions 1 and 3 shown in FIG. 5. As seen from FIG. 13, the direction specific correlation statistic dirCorr may provide discrimination to detect positions 1 and 3.

However, direction specific correlation statistic dirCorr may be unable to discriminate between the speech in position 2 shown in FIG. 5 and diffuse background noise. Nevertheless, broadside statistic block 88 may detect speech from position 2 by estimating a variance of the directional maximum normalized cross-correlation statistic, $\gamma_3$ [n] from the region, [$Ø_1$ $Ø_2$], and determining if such variance is small which may indicate a near-field signal arriving from a broadside direction (e.g., position 2). Broadside statistic block 88 may compute the variance by keeping track of the running average of the statistic $\gamma_3$ [n] as:

$$\mu_\gamma[n]=\delta_\vartheta\mu_\gamma[n-1]+(1-\delta_\vartheta)\gamma_3[n]$$

$$\vartheta_0[n]=\delta_\vartheta\vartheta_0[n-1]+(1-\delta_\vartheta)(\gamma_3[n]-\mu_\gamma[n])^2$$

where $\mu_\gamma$ [n] is the mean of $\gamma_3$ [n], $\delta_\vartheta$ is a smoothing constant corresponding to a duration of the running average and $\vartheta_0$[n] represents the variance of $\gamma_3$ [n].

A spatial resolution of the cross-correlation sequence may first be increased by interpolating the cross-correlation sequence using a Lagrange interpolation function. Direction of arrival block 86 may compute direction of arrival (DOA) statistic doa by selecting a lag corresponding to a maximum value of the interpolated cross-correlation sequence, $\tilde{r}_{x1x2}$ [m], as:

$$l_{max} = \arg\max_{\forall m} \{\tilde{r}_{x1x2}[m]\}$$

Direction of arrival block 86 may convert such selected lag index into an angular value by using the following formula to determine DOA statistic doa as:

$$\theta = \sin^{-1}\left(\frac{cl_{max}}{dF_r}\right)$$

where $F_r$=r$F_s$ is the interpolated sampling frequency and r is the interpolation rate. To reduce the estimation error due to outliers, direction of arrival block 86 may use median filter DOA statistic doa to provide a smoothed version of the raw DOA statistic doa. The median filter window size may be set at any suitable number of estimates (e.g., three).

If a dual microphone array is in the vicinity of the desired signal source, inter-microphone level difference block 90 may exploit the $R^2$ loss phenomenon by comparing the signal levels between the two microphones 51 to generate an inter-microphone level difference statistic imd. Such inter-microphone level difference statistic imd may be used to differentiate between a near-field desired signal and a far-field or diffuse field interfering signal, if the near-field signal is sufficiently louder than the far-field signal. Inter-microphone level difference block 90 may calculate inter-microphone level difference statistic imd as the ratio of the energy of the first microphone signal $x_1$ to the second microphone energy $x_2$:

$$imd = \frac{E_{x1}}{E_{x2}}.$$

Inter-microphone level difference block 90 may smooth this result as:

$$\rho[n]=\delta_\rho n-1]+(1-\delta_\rho)imd[n].$$

Switching of a selected beam by beam selector 58 may be triggered only when speech is present in the background. In order to avoid false alarms from competing talker speech that may arrive from different directions, three instances of voice activity detection may be used. Specifically, speech detectors 92 may perform voice activity detection on the outputs of beamformers 54. For example, in order to switch to beam former 1, speech detector 92*a* must detect speech at the output of beam former 1. Any suitable technique may be used for detecting the presence of speech in a given input signal.

Controller 56 may be configured to use the various statistics described above to detect the presence of speech from the various positions of orientation of the microphone array.

Figure 14:
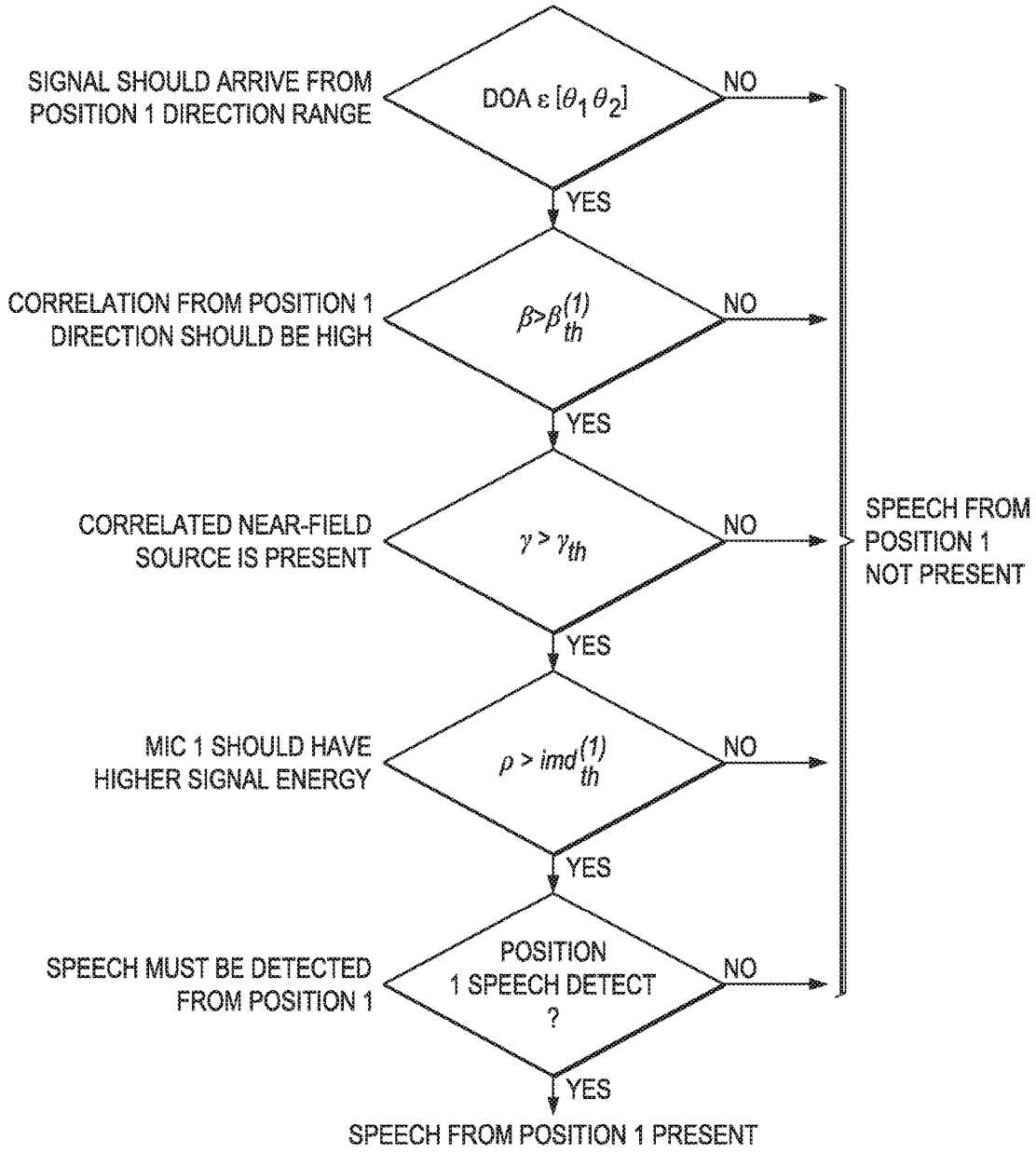
FIG. 14 illustrates a flow chart depicting example comparisons to be made to determine if speech is present from a first particular direction relative to a microphone array, in accordance with embodiments of the present disclosure.

FIG. 14 illustrates a flow chart depicting example comparisons that may be made by controller 56 to determine if speech is present from position 1 as shown in FIG. 5, in accordance with embodiments of the present disclosure. As shown in FIG. 14, speech may be determined to be present from position 1 if: (i) the direction of arrival statistic doa is within a particular range; (ii) the direction-specific correlation statistic dirCorr is above a predetermined threshold; (iii) the normalized maximum correlation statistic normMaxCorr is above a predetermined threshold; (iv) the inter-microphone level difference statistic imd is greater than a predetermined threshold; and (v) speech detector 92*a* detects that speech is present from position 1.

Figure 15:
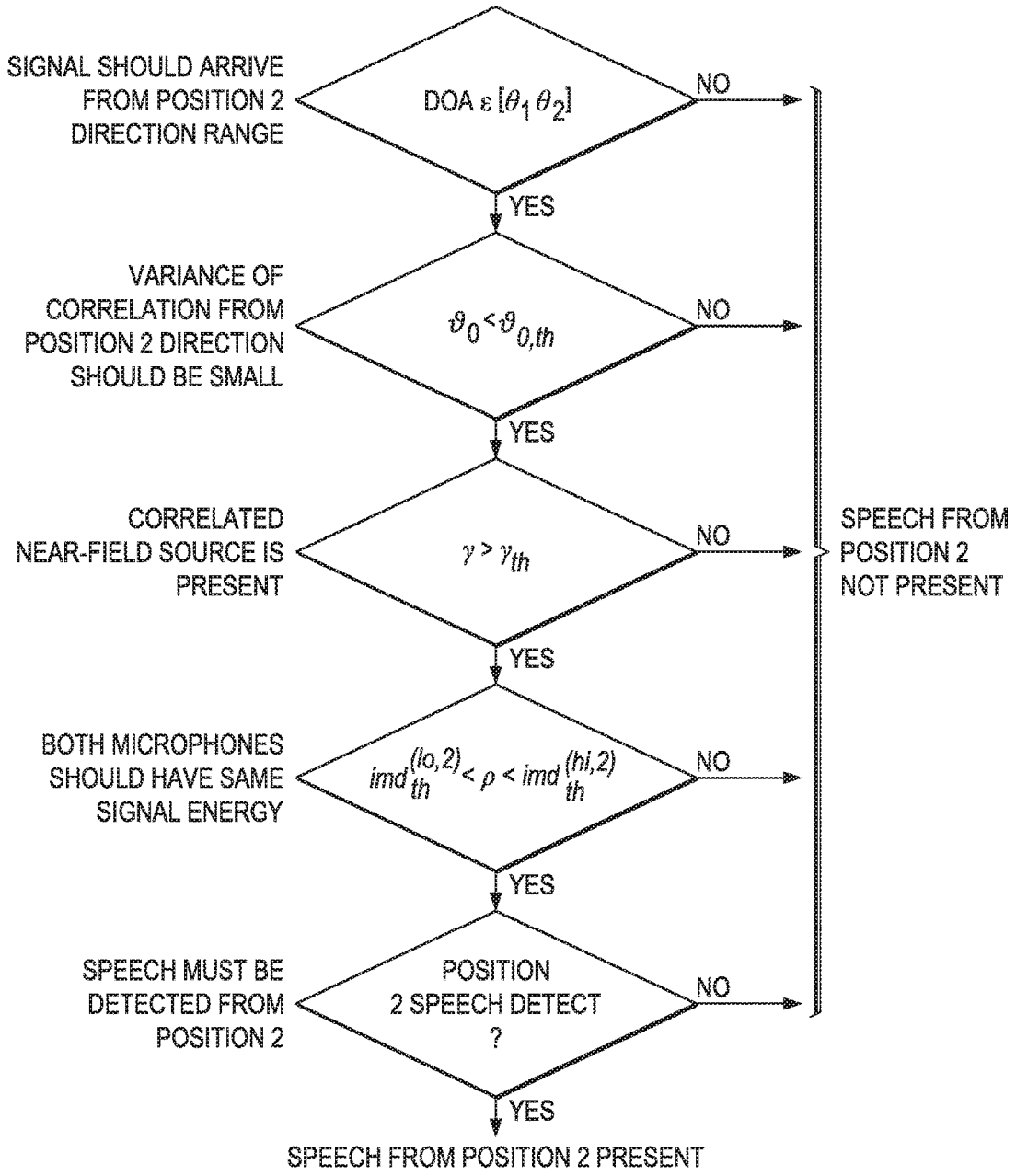
FIG. 15 illustrates a flow chart depicting example comparisons to be made to determine if speech is present from a second particular direction relative to a microphone array, in accordance with embodiments of the present disclosure.

FIG. 15 illustrates a flow chart depicting example comparisons that may be made by controller 56 to determine if speech is present from position 2 as shown in FIG. 5, in accordance with embodiments of the present disclosure. As shown in FIG. 15, speech may be determined to be present from position 2 if: (i) the direction of arrival statistic doa is within a particular range; (ii) the broadside statistic is below a particular threshold; (iii) the normalized maximum correlation statistic normMaxCorr is above a predetermined threshold; (iv) the inter-microphone level difference statistic imd is within a range indicating that microphone signals $x_1$ and $x_2$ have approximately the same energy; and (v) speech detector 92*b* detects speech that is present from position 2.

Figure 16:
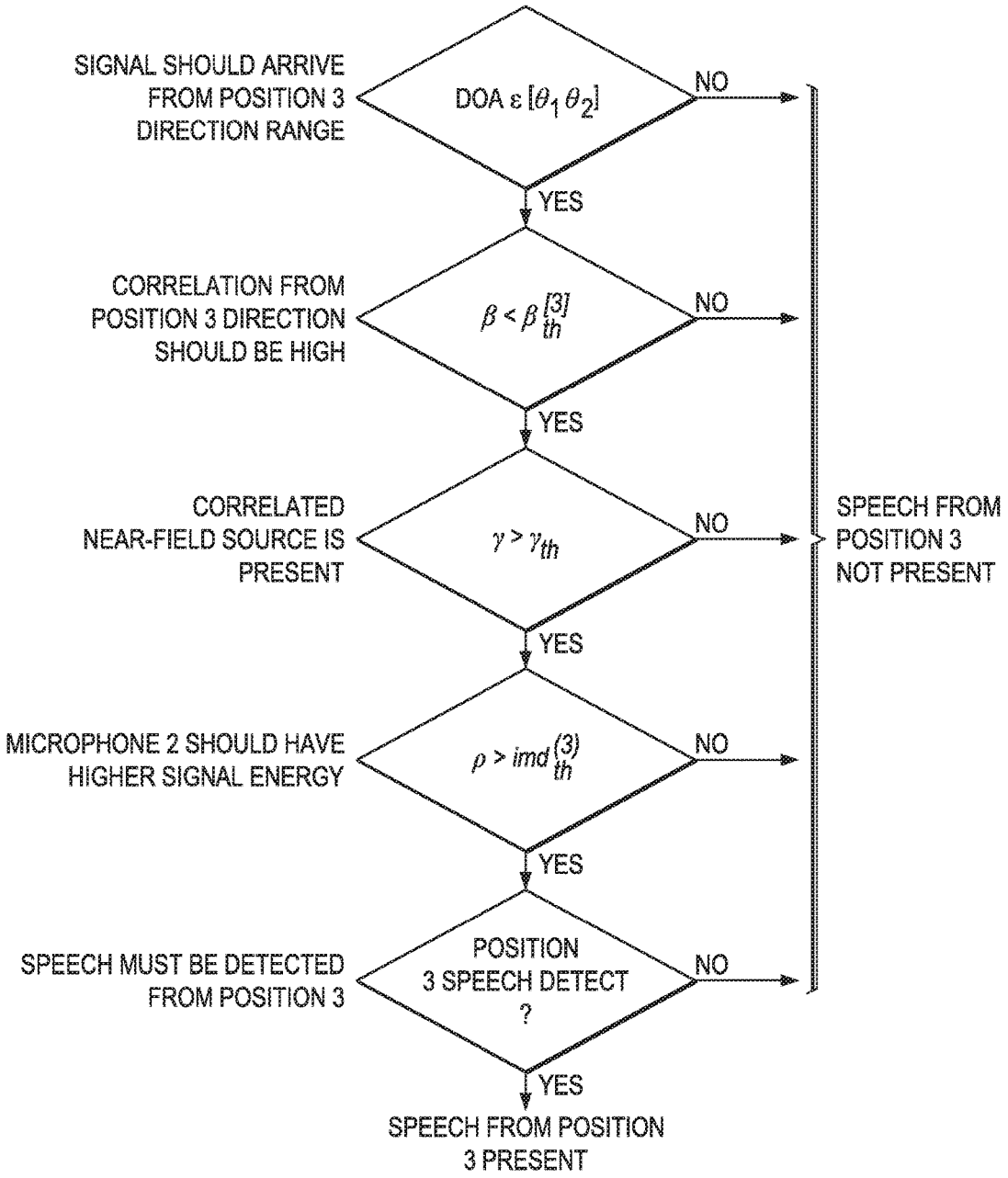
FIG. 16 illustrates a flow chart depicting example comparisons to be made to determine if speech is present from a third particular direction relative to a microphone array, in accordance with embodiments of the present disclosure.

FIG. 16 illustrates a flow chart depicting example comparisons that may be made by controller 56 to determine if speech is present from position 3 as shown in FIG. 5, in accordance with embodiments of the present disclosure. As shown in FIG. 16, speech may be determined to be present from position 3 if: (i) the direction of arrival statistic doa is within a particular range; (ii) the direction-specific correlation statistic dirCorr is below a predetermined threshold; (iii) the normalized maximum correlation statistic normMaxCorr is above a predetermined threshold; (iv) the inter-microphone level difference statistic imd is lesser than a predetermined threshold; and (v) speech detector 92*c* detects that speech is present from position 3.

Figure 17:
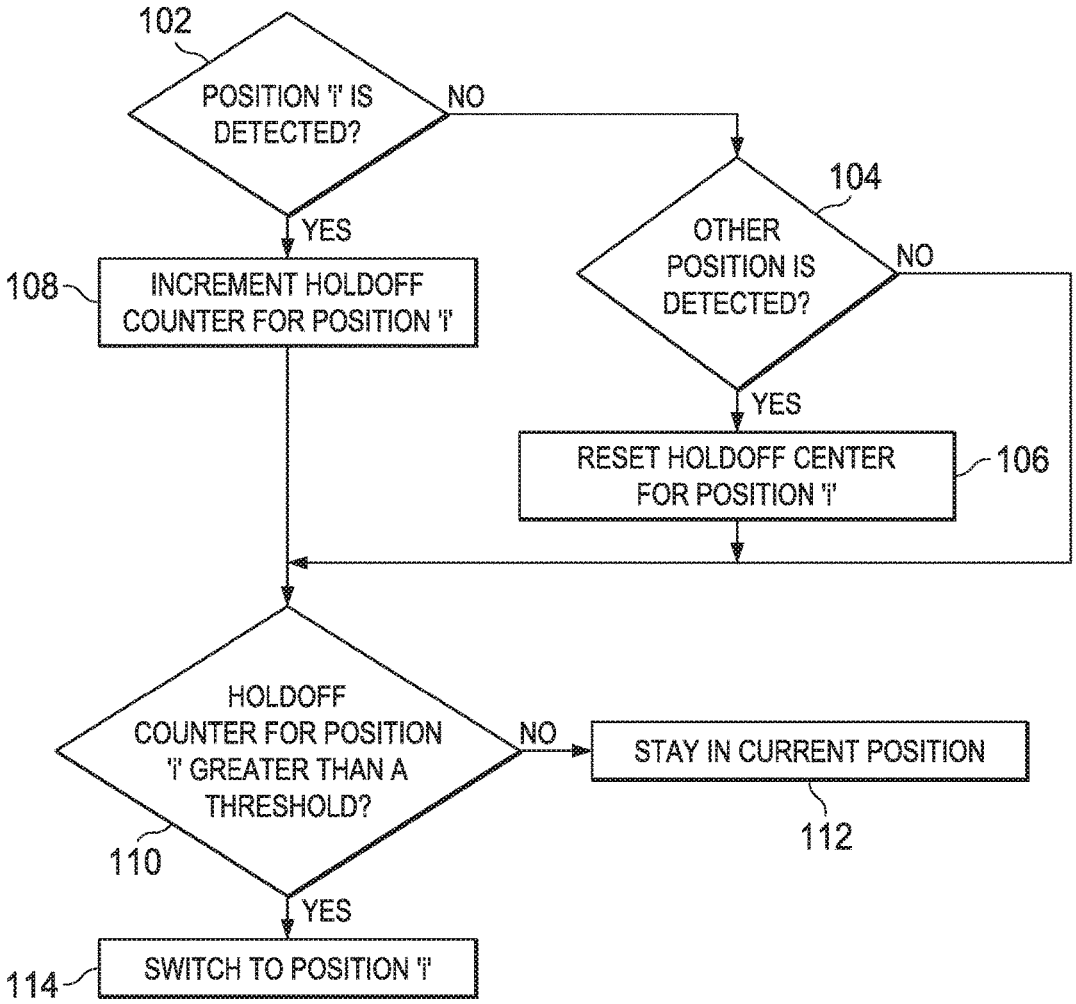
FIG. 17 illustrates a flow chart depicting an example holdoff mechanism, in accordance with embodiments of the present disclosure.

As shown in FIG. 17, controller 56 may implement holdoff logic to avoid premature or frequent switching of the selected beam former 54. For example, as shown in FIG. 17, controller 56 may cause beam selector 58 to switch between beamformers 54 when a threshold number of instantaneous speech detection in the look direction for an unselected beam former 54 has occurred. For example, the holdoff logic may begin at step 102 by determining whether sound from a position "i" is detected. If sound from position "i" is not detected, at step 104, the holdoff logic may determine if sound from another position is detected. If sound from another position is detected, the holdoff logic at step 106 may reset a holdoff counter for position "i."

If at step 102, if sound from position "i" is detected, at step 108, the holdoff logic may increment the holdoff counter for position "i."

At step 110, the holdoff logic may determine if the holdoff counter is for position "i" is greater than a threshold. If lesser than the threshold, controller 56 may maintain the selected beam former 54 in the current position at step 112. Otherwise, if greater than the threshold, controller 56 may switch the selected beam former 54 to the beam former 54 having a look direction of position "i" at step 114.

Holdoff logic as described above may be implemented in each position/look direction of interest.

Turning again to FIG. 6, after processing by spatially-controlled adaptive filter 62, the resulting signal may be processed by other signal processing blocks. For example, spatially-controlled noise reducer 64 may improve an estimation of background noise if the spatial controls generated by controller 56 indicate that speech-like interference is not the desired speech.

Furthermore, when an orientation of the microphone array is changed, the microphone input signal level may vary as a function of the array proximity to user's mouth. This sudden signal level change may introduce undesirable audio artifacts at the processed output. Accordingly, spatially-controlled automatic level controller 66 may control the signal compression/expansion level dynamically based on changes in orientation of the microphone array. For example, attenuation can be quickly applied to the input signal to avoid saturation when the array is brought very close to the mouth. Specifically, if the array is moved from position 1 to position 3, the positive gain in the automatic level control system which was originally adapted in position 1 can clip the signal coming from position 3. Similarly, if the array is moved from position 3 to position 1, the negative gain in the automatic level control system that was meant for position 3 can attenuate the signal coming from position 1, thereby causing the processed output to be quiet until the gain adapts back for position 3. Accordingly, spatially-controlled automatic level controller 66 may mitigate these issues by bootstrapping an automatic level control with an initial gain that is relevant for each position. Spatially-controlled automatic level controller 66 may also adapt from this initial gain to account for speech-level dynamics.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments likewise, with the benefit of this disclosure, will be apparent to those having ordinary skill in the art, and such embodiments should be deemed as being encompassed herein.

What is claimed is:

1. A method for voice processing in an audio device having an array of a plurality of microphones wherein the array is capable of having a plurality of positional orientations relative to a user of the array, the method comprising:

periodically computing a plurality of normalized cross-correlation functions, each cross-correlation function corresponding to a possible orientation of the array with respect to a desired source of speech;

determining an orientation of the array relative to the desired source of speech based on the plurality of normalized cross-correlation functions;

detecting changes in the orientation of the array based on the plurality of normalized cross-correlation functions; and responsive to a change in the orientation of the array, dynamically modifying voice processing parameters of the audio device such that speech from the desired source of the speech is preserved while reducing interfering sounds; wherein dynamically modifying voice processing parameters of the audio device comprises processing speech to account for changes in proximity of the array of the plurality of microphones with respect to the desired source of speech.

2. The method of claim 1, wherein the audio device comprises a headset.

3. The method of claim 2, wherein the array of the plurality of microphones is located in a control box of the headset such that the location of the array of the plurality of microphones relative to the desired source of speech is unfixed.

4. The method of claim 1, wherein the desired source of speech is a mouth of the user.

5. The method of claim 1, wherein modifying voice processing parameters comprises selecting a directional beamformer from a plurality of directional beamformers of the audio device for processing sound energy.

6. The method of claim 5, further comprising calibrating the array of the plurality of microphones responsive to a presence of at least one of: near-field speech for compensation of near-field propagation loss, diffused noise, and far-field noise.

7. The method of claim 6, wherein calibrating the array of the plurality of microphones comprises generating a calibration signal that is used by the directional beamformer for processing sound energy.

8. The method of claim 6, wherein calibrating the array of the plurality of microphones comprises calibrating based on the change in orientation of the array.

9. The method of claim 5, further comprising detecting presence of speech based on an output of the plurality of directional beamformers.

10. The method of claim 1, wherein a look direction of the directional beamformer is dynamically modified based on the change in orientation of the array.

11. The method of claim 1, further comprising adaptively cancelling spatially non-stationary noises with an adaptive spatial filter.

12. The method of claim 11, further comprising generating a noise reference to the adaptive spatial filter using an adaptive nullformer.

13. The method of claim 12, further comprising:

tracking a direction of arrival of speech from the desired source of speech; and dynamically modifying a null direction of the adaptive nullformer based on the direction of arrival of speech and the change in orientation of the array.

14. The method of claim 12, further comprising calibrating the array of the plurality of microphones responsive to a presence of at least one of: near-field speech for compensation of near-field propagation loss, diffused noise, and far-field noise, wherein calibrating the array of the plurality of microphones comprises generating the noise reference.

15. The method of claim 11, comprising:

monitoring for a presence of near-field speech; and halting adaptation of the adaptive spatial filter in response to detection of the presence of near-field speech.

16. The method of claim 1, further comprising tracking a direction of arrival of speech from the desired source of speech.

17. The method of claim 1, further comprising controlling noise estimation of a single-channel noise reduction algorithm based on the orientation of the array.

18. The method of claim 1, further comprising detecting the orientation of the array based on the plurality of normalized cross-correlation functions, an estimate of a direction of arrival from a desired source of sound, an inter-microphone level difference, and a presence or absence of speech.

19. The method of claim 1, further comprising validating the orientation of the array using a holdoff mechanism.

20. An integrated circuit for implementing at least a portion of an audio device, comprising:

an audio output configured to reproduce audio information by generating an audio output signal for communication to at least one transducer of the audio device;

an array of a plurality of microphones wherein the array is capable of having a plurality of positional orientations relative to a user of the array; and a processor configured to implement a near-field detector configured to:

periodically compute a plurality of normalized cross-correlation functions, each cross-correlation function corresponding to a possible orientation of the array with respect to a desired source of speech;

determine an orientation of the array relative to the desired source of speech based on the plurality of normalized cross-correlation functions;

detect changes in the orientation of the array based on the plurality of normalized cross-correlation functions; and responsive to a change in the orientation of the array, dynamically modify voice processing parameters of the audio device such that speech from the desired source of speech is preserved while reducing interfering sounds; wherein dynamically modifying voice processing parameters of the audio device comprises processing speech to account for changes in proximity of the array of the plurality of microphones with respect to the desired source of speech.

21. The integrated circuit of claim 20, wherein the audio device comprises a headset.

22. The integrated circuit of claim 20, wherein the array of the plurality of microphones is located in a control box of the headset such that the location of the array of the plurality of microphones relative to the desired source is unfixed.

23. The integrated circuit of claim 20, wherein the desired source of speech is a mouth of the user.

24. The integrated circuit of claim 20, wherein modifying voice processing parameters comprises selecting a directional beamformer from a plurality of directional beamformers of the audio device for processing sound energy.

25. The integrated circuit of claim 24, further comprising calibrating the array of the plurality of microphones responsive to a presence of at least one of: near-field speech for compensation of near-field propagation loss, diffused noise, and far-field noise.

26. The integrated circuit of claim 25, wherein calibrating the array of the plurality of microphones comprises generating a calibration signal that is used by the directional beamformer for processing sound energy.

27. The integrated circuit of claim 25, wherein calibrating the array of the plurality of microphones comprises calibrating based on the change in orientation of the array.

28. The integrated circuit of claim 24, further comprising detecting presence of speech based on an output of the plurality of directional beamformers.

29. The integrated circuit of claim 24, wherein a look direction of the directional beamformer is dynamically modified based on the change in orientation of the array.

30. The integrated circuit of claim 20, further comprising adaptively cancelling spatially non-stationary noises with an adaptive spatial filter.

31. The integrated circuit of claim 30, further comprising generating a noise reference to the adaptive spatial filter using an adaptive nullformer.

32. The integrated circuit of claim 31, further comprising:

tracking a direction of arrival of speech from the desired source of speech; and dynamically modifying a null direction of the adaptive nullformer based on the direction of arrival and the change in orientation of the array.

33. The integrated circuit of claim 31, further comprising calibrating the array of the plurality of microphones responsive to a presence of at least one of: near-field speech for compensation of near-field propagation loss, diffused noise, and far-field noise, wherein calibrating the array of the plurality of microphones comprises generating the noise reference.

34. The integrated circuit of claim 30, comprising:

monitoring for a presence of near-field speech; and halting adaptation of the adaptive spatial filter in response to detection of the presence of near-field speech.

35. The integrated circuit of claim 20, further comprising tracking a direction of arrival of speech from the desired source of speech.

36. The integrated circuit of claim 20, further comprising controlling noise estimation of a single-channel noise reduction algorithm based on the orientation of the array.

37. The integrated circuit of claim 20, further comprising detecting the orientation of the array based on the plurality of normalized cross-correlation functions, an estimate of a direction of arrival from a desired source of sound, an inter-microphone level difference, and a presence or absence of speech.

38. The integrated circuit of claim 20, further comprising validating the orientation of the array using a holdoff mechanism.

* * * * *